US008550879B2

(12) United States Patent
Chen et al.

(10) Patent No.: US 8,550,879 B2
(45) Date of Patent: Oct. 8, 2013

(54) POLISHING PAD CONDITIONER

(75) Inventors: Hung Chih Chen, Sunnyvale, CA (US); Sen-Hou Ko, Sunnyvale, CA (US); Shou-Sung Chang, Stanford, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1341 days.

(21) Appl. No.: 12/256,845

(22) Filed: Oct. 23, 2008

(65) Prior Publication Data

US 2010/0105302 A1 Apr. 29, 2010

(51) Int. Cl.
*B24B 1/00* (2006.01)
*B24B 21/18* (2006.01)

(52) U.S. Cl.
USPC ..... 451/56; 451/443

(58) Field of Classification Search
USPC ..... 451/56, 443, 444, 446
See application file for complete search history.

(56) References Cited

U.S. PATENT DOCUMENTS 6,093,280 A * 7/2000 Kirchner et al. ..... 156/345.12
6,190,243 B1 * 2/2001 Wada et al. ..... 451/288
6,386,963 B1 5/2002 Kenji et al.
6,551,176 B1 4/2003 Garretson
6,572,446 B1 6/2003 Osterheld et al.
6,764,389 B1 * 7/2004 Butterfield et al. ..... 451/56
6,893,336 B2 * 5/2005 Jin ..... 451/443
6,935,938 B1 * 8/2005 Gotkis et al. ..... 451/443
7,004,825 B1 * 2/2006 Taylor et al. ..... 451/72
7,097,545 B2 * 8/2006 Lee et al. ..... 451/72
7,182,680 B2 2/2007 Butterfield et al.
7,210,988 B2 5/2007 Wang et al
7,288,165 B2 * 10/2007 Polyak et al. ..... 156/345.12
7,597,608 B2 * 10/2009 Chang et al. ..... 451/56
2004/0203325 A1 10/2004 Donohue
2006/0079160 A1 4/2006 Balagani et al.

* cited by examiner

*Primary Examiner* — Dung Van Nguyen
(74) *Attorney, Agent, or Firm* — Patterson & Sheridan, LLP

(57) ABSTRACT

Embodiments of the present invention generally provide an improved conditioning module and conditioning disks for improved pressure distribution during the process of conditioning a polishing pad of a chemical mechanical polishing (CMP) system. In one embodiment, a conditioning module comprising multiple, small conditioning disks is provided. In one embodiment, a conditioning disk having a compliant backing member is provided. In one embodiment, the compliant backing member comprises a semi-rigid backing member cut into a spiral shape to provide compliancy. In another embodiment, the compliant backing member comprises a fluid-pressurized, flexible membrane. Each embodiment of the present invention provides an improved pressure distribution across the face of each conditioning disk, resulting in increased disk life as well as increased conditioning rate and uniformity.

14 Claims, 5 Drawing Sheets

POLISHING PAD CONDITIONER

BACKGROUND OF THE INVENTION

1. Field of the Invention

Embodiments of the present invention generally relate to a pad conditioning module and disk for conditioning chemical mechanical polishing pads.

2. Description of the Related Art

Chemical mechanical polishing (CMP) is used to smooth the surface topography of a substrate in the manufacture of integrated circuits, displays, photovoltaic devices, and the like. CMP removes materials from the substrate surface in part by chemical dissolution, while concurrently mechanically polishing the substrate. Chemical dissolution is performed by applying reactive chemical slurry to the substrate surface to remove materials from the substrate surface. The slurry is applied to the substrate surface by contact with a polishing pad disposed on a platen. A mechanical component of the polishing process is performed by providing relative motion between the substrate, the polishing pad, and the slurry therebetween.

After polishing a number of substrates, the polishing pad degrades and/or becomes "glazed" and is unable to consistently provide a desired polishing uniformity and rate. Glazing occurs when the polishing pad becomes excessively worn. The peaks of the polishing pad are pressed down and the pits of the polishing pad are filled with particulates, resulting in a smoother, less abrasive polishing surface.

To remedy polishing pad glazing, the pad is periodically conditioned by a pad conditioning disk having a conditioning face with abrasive particles, such as diamond particles, which is pressed against the used polishing surface of the polishing pad. The pad conditioning disk is typically mounted on an arm that oscillates while the conditioning disk is rotated and pressed against the polishing surface of the polishing pad.

However, often times, the surface of a conventional pad conditioning disk becomes pitted or eroded as a result of repetitive conditioning of the polishing surface of the polishing pad due to uneven contact with the surface of the polishing pad.

Therefore, an improved conditioning disk is needed that is capable of providing improved pressure distribution to the polishing surface of a polishing pad during conditioning of the polishing pad.

SUMMARY OF THE INVENTION

In one embodiment of the present invention, a module for conditioning a polishing pad in a chemical mechanical polishing system comprises a main body rotatable on its central axis and having a support arm extending therefrom, a plurality of conditioning heads attached to the support arm and extending downwardly therefrom, and a conditioning disk extending downwardly from each conditioning head. In one embodiment, each conditioning disk comprises a compliant portion and an abrasive portion.

In another embodiment, a disk for conditioning a polishing pad in a chemical mechanical polishing system comprises a compliant support member, a spiral shaped backing member attached to the compliant support member, and an abrasive sheet member attached to the spiral shaped backing member.

In another embodiment, a conditioning disk for conditioning a polishing pad in a chemical mechanical polishing system comprises a fluid filled flexible membrane, an abrasive sheet attached to the fluid filled flexible membrane, and a fluid actuator in fluid communication with the flexible membrane to adjust the pressure of the fluid inside the flexible membrane.

In yet another embodiment, a method of conditioning a polishing pad in a chemical mechanical polishing system comprises applying a conditioning disk to a polishing pad and moving the conditioning disk, the polishing pad, or both. In one embodiment, the conditioning disk comprises a compliant support member, a spiral shaped backing member attached to the compliant support member, and an abrasive sheet member attached to the spiral shaped backing member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally provide an improved conditioning module and conditioning disks for improved pressure distribution during the process of conditioning a polishing pad of a chemical mechanical polishing (CMP) system. In one embodiment, a conditioning module comprising multiple, small conditioning disks is provided. In one embodiment, a conditioning disk having a compliant backing member is provided. In one embodiment, the compliant backing member comprises a semi-rigid backing member cut into a spiral shape to provide compliancy. The spiral-shaped backing member may be supported by a compliant, support member. In another embodiment, the compliant backing member comprises a fluid-pressurized, flexible membrane. Each embodiment of the present invention provides improved pressure distribution across the face of each conditioning disk, resulting in increased disk life as well as increased conditioning rate and uniformity.

Figure 1:
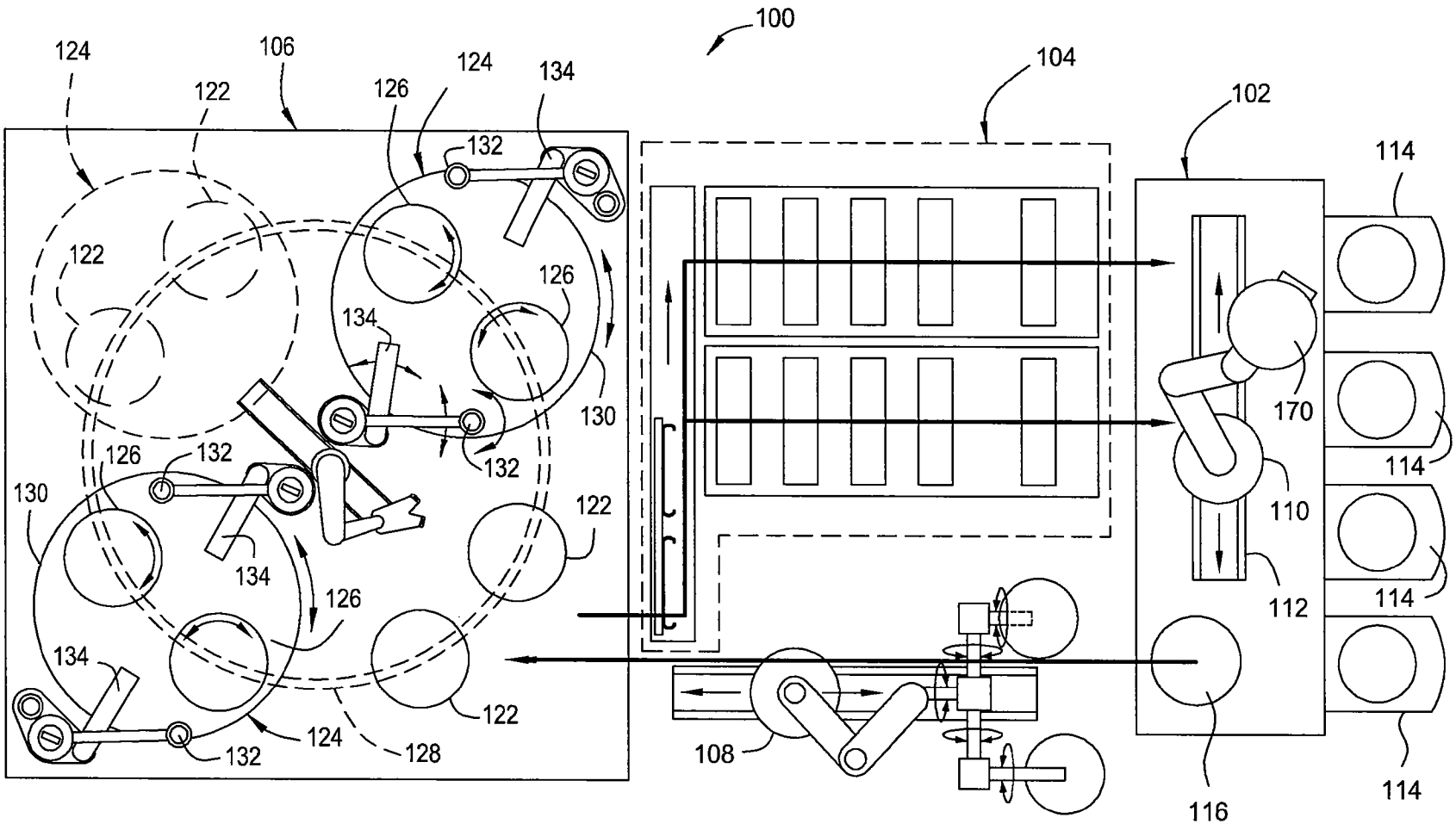
FIG. 1 is a top view illustrating a chemical mechanical polishing (CMP) system that may benefit from the present invention.

FIG. 1 is a top view illustrating a chemical mechanical polishing (CMP) system 100 that may benefit from the present invention. The CMP system 100 includes a factory interface 102, a cleaner 104, and a polishing module 106. A wet robot 108 is provided to transfer substrates 170 between the factory interface 102 and the polishing module 106. The wet robot 108 may also be configured to transfer substrates between the polishing module 106 and the cleaner 104. The factory interface 102 includes a dry robot 110, which is configured to transfer substrates 170 between one or more cassettes 114 and one or more transfer platforms 116. In one embodiment depicted in FIG. 1, four substrate storage cassettes 114 are shown. The dry robot 110 has sufficient range of motion to facilitate transfer between the four cassettes 114 and the one or more transfer platforms 116. Optionally, the dry robot 110 may be mounted on a rail or track 112 to position the robot 110 laterally within the factory interface 102, thereby increasing the range of motion of the dry robot 110 without requiring large or complex robot linkages. The dry robot 110 additionally is configured to receive substrates from the cleaner 104 and return the cleaned and polished substrates to the substrate storage cassettes 114. Although one substrate transfer platform 116 is shown in the embodiment depicted in FIG. 1, two or more substrate transfer platforms may be provided so that at least two substrates may be queued for transfer to the polishing module 106 by the wet robot 108 at the same time.

The polishing module 106 includes a plurality of polishing stations 124 on which substrates are polished, while retained in one or more polishing heads 126. The polishing stations 124 are sized to interface with two or more polishing heads 126 simultaneously so that polishing of two or more substrates may occur using a single polishing station 124 at the same time. The polishing heads 126 are coupled to a carriage 220 (shown in FIG. 2) that is mounted to an overhead track 128 that is shown in phantom in FIG. 1. The overhead track 128 allows the carriage 220 to be selectively positioned around the polishing module 106, which facilitates positioning of the polishing heads 126 selectively over the polishing stations 124 or load cups 122. In the embodiment depicted in FIG. 1, the overhead track 128 has a circular configuration, which allows the carriages 220 retaining the polishing heads 126 to be selectively and independently rotated over and/or clear of the load cups 122 and the polishing stations 124. The overhead track 128 may have other configurations including elliptical, oval, linear, or other suitable orientations.

As depicted in FIG. 1, two polishing stations 124 are located in opposite corners of the polishing module 106. At least one load cup 122 is in the corner of the polishing module 106 between the polishing stations 124 closest the wet robot 108. Each load cup 122 facilitates transfer of a substrate between the wet robot 108 and the polishing head 126. Optionally, a third polishing station 124 (shown in phantom) may be positioned in the corner of the polishing module 106 opposite the load cups 122. Alternatively, a second pair of load cups 122 (also shown in phantom) may be located in the corner of the polishing module 106 opposite the load cups 122 that are positioned proximate the wet robot 108. Additional polishing stations 124 may be integrated in the polishing module 106 in systems having a larger footprint.

Each polishing station 124 includes a polishing surface 130 capable of polishing at least two substrates at the same time and a corresponding polishing unit for each of the substrates. Each of the polishing units includes a polishing head 126, a conditioning module 132, and a polishing fluid delivery module 134. The polishing fluid delivery module 134 may be a slurry delivery arm. The polishing surface 130 is supported on a platen assembly (not shown), which rotates the polishing surface 130 during processing.

Figure 2:
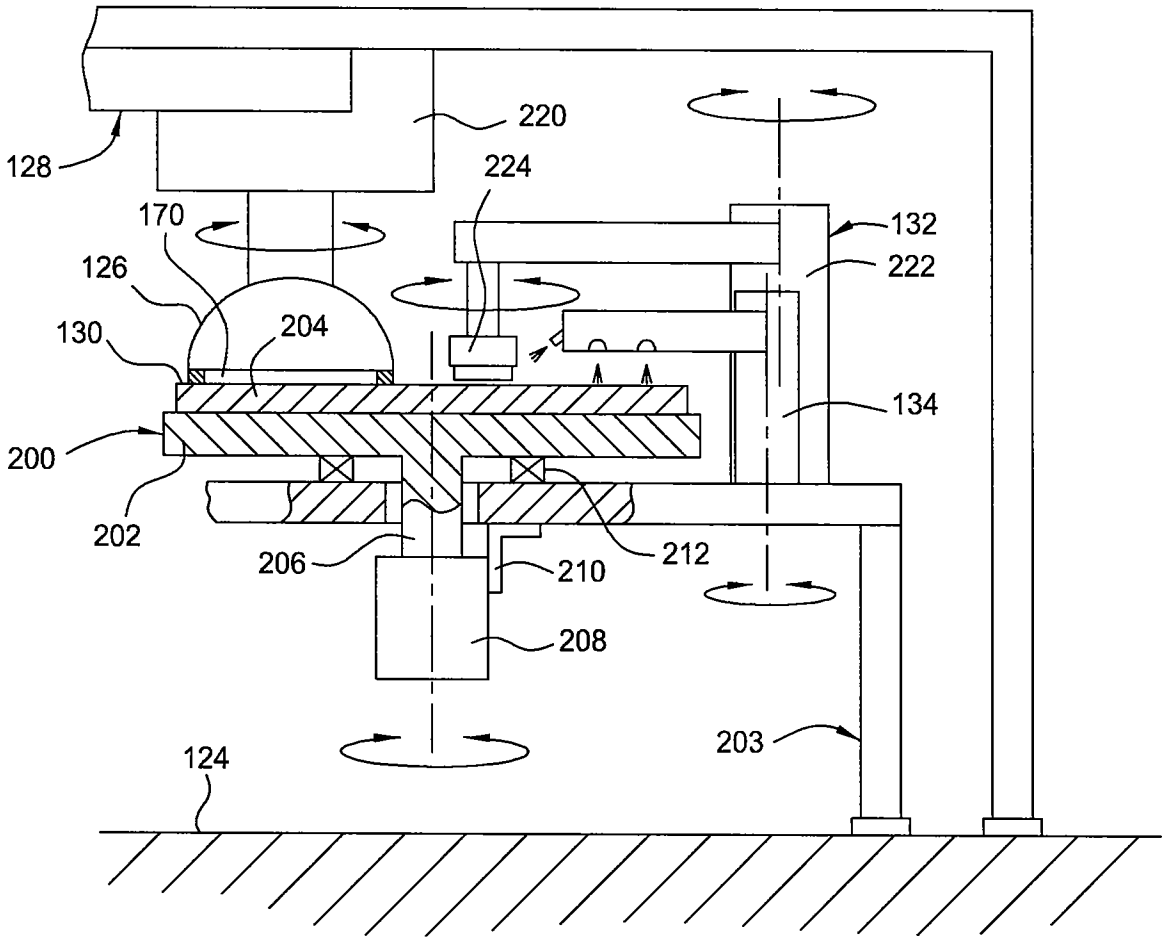
FIG. 2 is a partial side view showing an exemplary polishing station of FIG. 1.

FIG. 2 is a partial side view showing an exemplary polishing station 124 of FIG. 1. A platen assembly 200 supports a dielectric polishing pad 204. The upper surface of the pad 204 forms the polishing surface 130. The platen assembly 200 includes a platen 202 movably supported on an inner frame 203 by one or more bearings 212. The platen assembly also includes a shaft 206 that couples the platen 202 to a motor 208. The motor 208 may be coupled to the inner frame 203 by a bracket 210. The motor 208 rotates the platen assembly 200 such that the pad 204 retained thereon is rotated during processing, while the substrate 170 is retained against the polishing surface 130 by the polishing head 126.

Polishing fluid is delivered through the polishing fluid delivery module 134 to the polishing surface 130 during processing. The distribution of polishing fluid provided by the polishing fluid delivery module 134 may be selected to control the distribution of polishing fluid across the lateral surface of the polishing surface 130. Additionally, the conditioning module 132 may be activated to contact and condition the polishing surface 130 during processing or as otherwise desired.

The conditioning module 132 depicted in FIG. 2 is a conventional conditioning module as known in the art. The conditioning module 132 includes a support post 222 coupled to the inner frame 203. The support post 222 may be rotationally driven via an actuator (not shown). The conditioning module 132 further comprises a conditioning head 224 attached to the support post 222 via a support arm 226. A conventional conditioning disk 228 is mounted to the conditioning head 224, which may be rotationally driven as well as vertically raised and lowered via actuators (not shown).

Figure 3A:
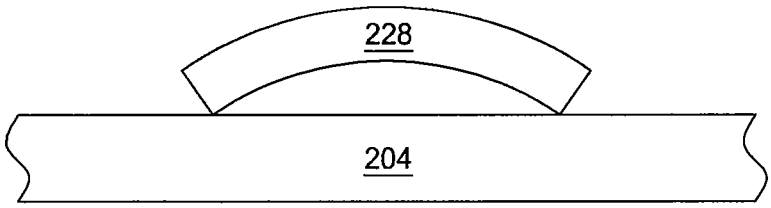
FIGS. 3A and 3B are schematic side views showing problems associated with prior art conditioning disks.
Figure 3B:
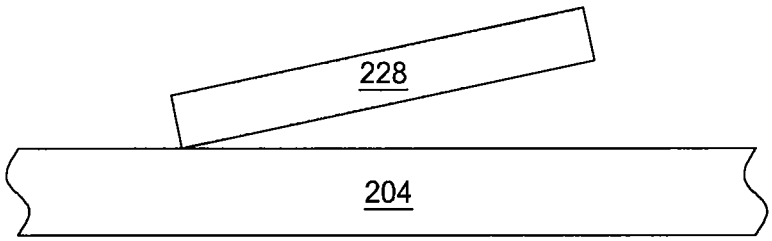

As previously set forth, the surface of a conventional pad conditioning disk 228 becomes pitted or eroded during repetitive conditioning of the polishing surface of the polishing pad 204 due to uneven contact with the surface of the polishing pad 204. For example, the conditioning disk 228 may bowed as shown in FIG. 3A. The result is greater wear around the perimeter of the conditioning disk 228 as opposed to the central region. In another example, the conditioning disk 228 may be applied to the polishing pad in a tilted or uneven fashion as shown in FIG. 3B. In either example, the conditioning disk 228 is subjected to an uneven force distribution across the surface of the conditioning disk 228, which results in uneven wear of the conditioning disk and, ultimately, poor conditioning of the polishing pad 204.

Figure 4A:
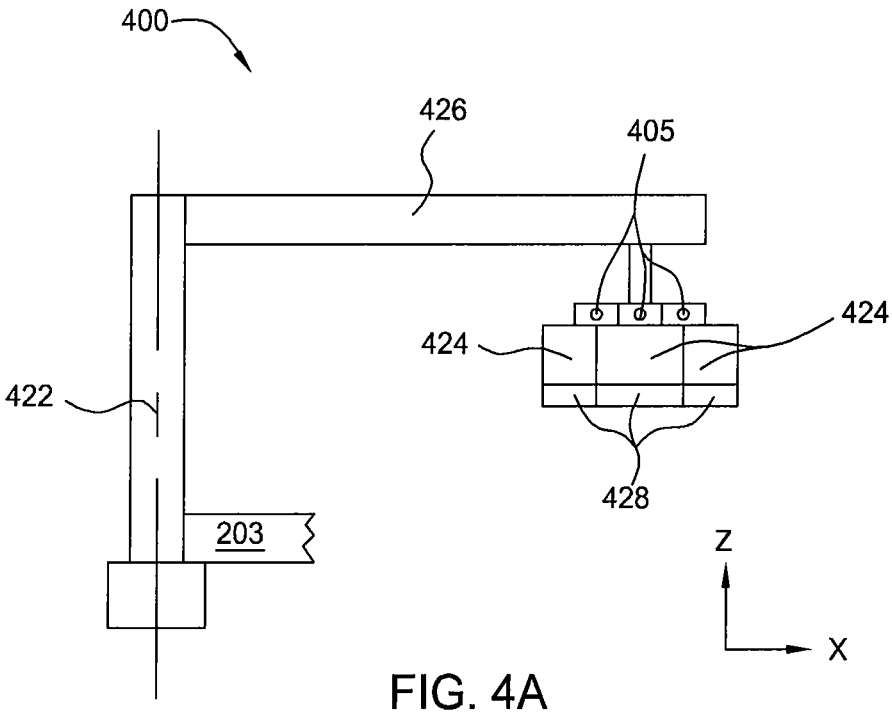
FIG. 4A is a schematic, side view of a conditioning module according to the present invention.
Figure 4B:
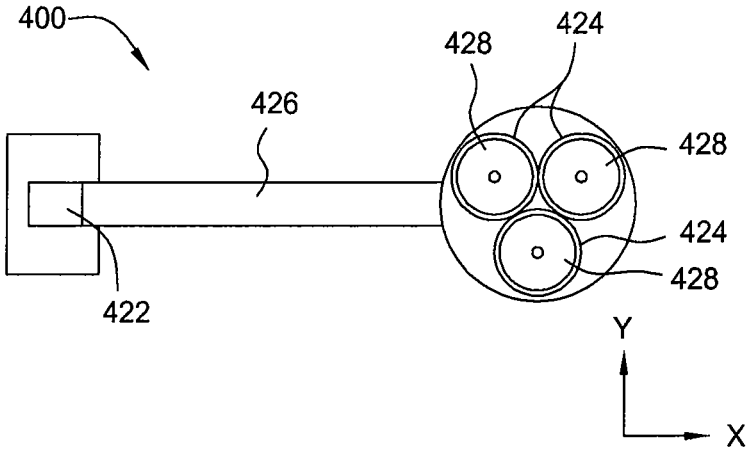
FIG. 4B is a schematic, bottom view of the conditioning module shown in FIG. 4A.

FIG. 4A is a side view and FIG. 4B is a bottom view of a conditioning module 400 according to one embodiment of the present invention. The conditioning module 400 includes a support post 422 coupled to an inner frame, such as inner frame 203. The support post 422 may be rotationally driven via an actuator (not shown). The conditioning module 400 further comprises at least two conditioning heads 424 attached to the support post 422 via a support arm 426. In one embodiment, the conditioning module 400 includes two conditioning heads 424. In one embodiment, the conditioning module 400 includes three conditioning heads 424 as shown in FIGS. 4A and 4B. In another embodiment, the conditioning module 400 includes four or more conditioning heads 424. A conditioning disk 428 is removably attached to each of the conditioning heads 424. It has been found that exerting a downward conditioning force through smaller, multiple conditioning disks 428 provides improved pressure distribution across the polishing surface of a polishing pad that a single, large conditioning disk, such as conventional conditioning disk 228. This results in improved wear rate of the conditioning disk 428 with increased conditioning disk life and, ultimately, improved polishing uniformity.

In one embodiment, a bearing member 405 attaches each of the conditioning heads 424 to the support arm 426. Each bearing member 405 allows rotation about both the x-axis and y-axis as depicted in FIG. 4B. In another embodiment, a single bearing member 405 attaches two or more conditioning heads 424 to the support arm 426.

Figure 5A:
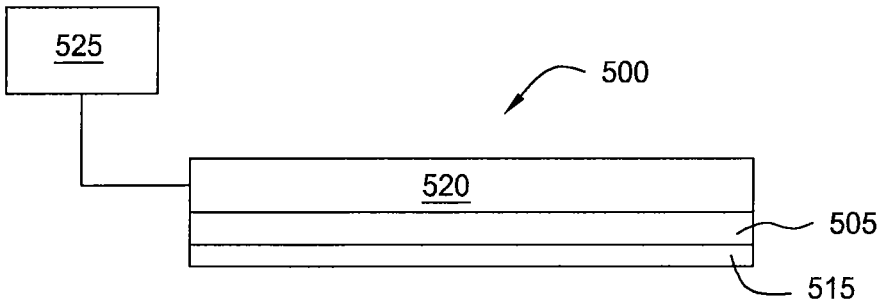
FIG. 5A is a schematic, cross-sectional, side view of a conditioning disk according to the present invention.
Figure 5B:
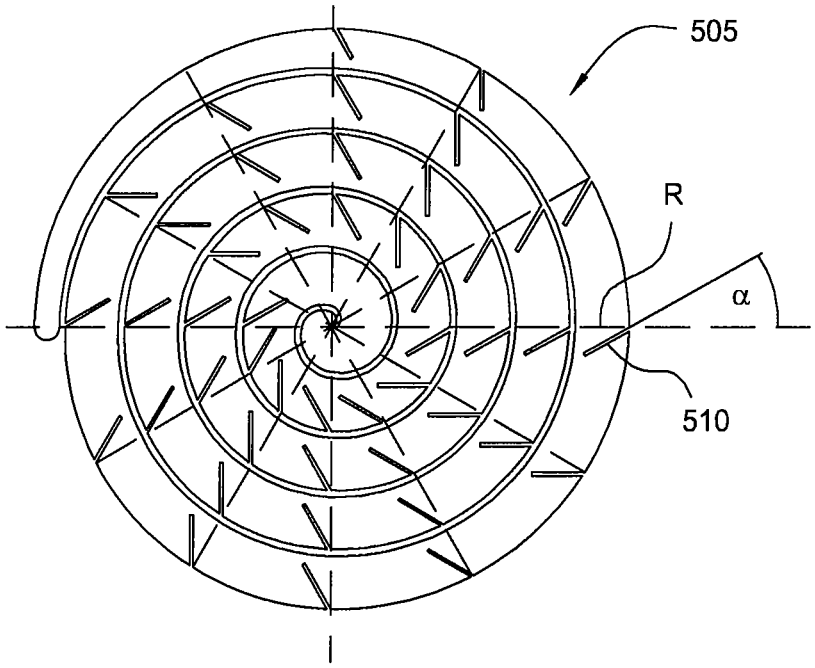
FIG. 5B is a schematic, top view of a backing member of the conditioning disk depicted in FIG. 5A.

FIG. 5A is a schematic side view of a conditioning disk 500 according to one embodiment of the present invention. In one embodiment, the conditioning disk 500 comprises a backing member 505 cut and shaped to be more compliant across the surface of the backing member 505. FIG. 5B is a schematic top view of the backing member 505. In one embodiment, the backing member 505 is cut into a spiral shape as depicted in FIG. 5B. In one embodiment, the backing member 505 comprises a thin metal sheet, such as stainless steel. In one embodiment, the backing member 505 is sized for conventional, single disk conditioning as depicted in FIG. 2. In one embodiment, the backing member 505 is sized for multiple disk conditioning as depicted in FIGS. 4A and 4B.

In one embodiment, a plurality of slots 510 is cut into the backing member 505. In one embodiment, each of the slots 510 extends from the outer perimeter of the spiral sections of the backing member 505 toward the center of the backing member 505. In one embodiment, each slot 510 extends inwardly from the outer perimeter of the spiral sections of the backing member 505 at an angle ($\alpha$) from a radius line (R) extending from the intersection of a perimeter of the spiral and the center of the backing plate 505 as depicted in FIG. 5. In one embodiment, the angle ($\alpha$) is from about 15° to about 75°. In one embodiment, the angle ($\alpha$) is from about 20° to about 45°.

In one embodiment, an abrasive member 515 is attached to the backing member 505. In one embodiment, the abrasive member 515 comprises a thin, diamond impregnated sheet. In one embodiment, the abrasive member 515 comprises a diamond impregnated metal matrix sheet. In one embodiment, the abrasive member 515 is backed with an adhesive.

In one embodiment, the conditioning disk 500 includes a compliant member 520 attached to the backing member 505. In one embodiment, the compliant member 520 is a compliant foam member. The compliant member is disposed between the backing member 505 and a conditioning head, such as the conditioning head 224 or 424. In one embodiment, the compliant member 520 is a flexible membrane. In one embodiment, the flexible membrane is a hollow membrane filled with fluid. In one embodiment, the flexible membrane comprises a rubber material or the like, capable of containing a fluid under pressure. The amount of compliance of the flexible membrane may be controlled by increasing or decreasing the fluid pressure inside the flexible membrane. In one embodiment, a fluid actuator 525, such as a pneumatic actuator, is used to increase or decrease the pressure of the fluid, such as air, inside the flexible membrane.

The spiral shape of the backing member 505 allows flexibility of each conditioning disk 500, which allows improved pressure distribution across the conditioning surface of the conditioning disk 500. Further, the addition of the compliant member 520 situated between the backing member 505 and a conditioning head provides support to the backing member 505 during the conditioning process, while maintaining the flexibility of the spiral shaped backing member 505, which allows improved pressure distribution across the conditioning surface of the conditioning disk 500. The improved pressure distribution results in improved wear rate of the conditioning disk 500 with increased disk life and, ultimately, improved polishing uniformity.

Figure 6:
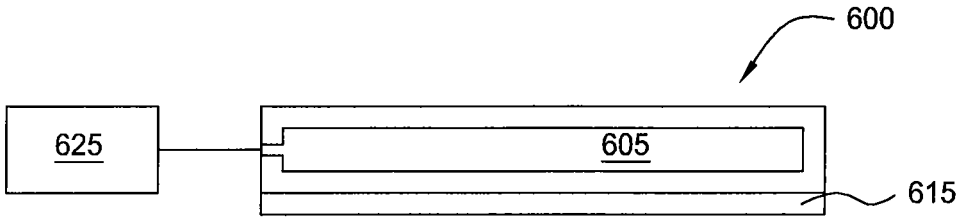
FIG. 6 is a schematic, cross-sectional, side view of another conditioning disk according to the present invention.

FIG. 6 is a schematic, cross sectional, side view of a conditioning disk 600 according to another embodiment of the present invention. The conditioning disk 600 comprises a compliant backing member 605 attached to an abrasive member 615. In one embodiment, the backing member 605 comprises a flexible, fluid filled membrane. In one embodiment, the membrane comprises a rubber material or the like, capable of retaining a fluid under pressure. In one embodiment, the pressure of the fluid, such as air, inside the backing member may be increased or decreased by a fluid actuator 625, such as a pneumatic actuator.

In one embodiment, the abrasive member 615 is attached to the compliant backing member 605. In one embodiment, the abrasive member 615 comprises a thin, diamond impregnated sheet. In one embodiment, the abrasive member 615 comprises a diamond impregnated metal matrix sheet. In one embodiment, the abrasive member 615 is backed with an adhesive. In one embodiment, the abrasive member is a diamond impregnated, flexible tape.

In one embodiment, the conditioning disk 600 is sized for conventional, single disk conditioning as depicted in FIG. 2. In one embodiment, the conditioning disk 600 is sized for multiple disk conditioning as depicted in FIGS. 4A and 4B.

The compliant backing member 605 allows flexibility of each conditioning disk 600, which allows improved pressure distribution across the conditioning surface of the conditioning disk 600. The improved pressure distribution results in improved wear rate of the conditioning disk 600 with improved disk life and, ultimately, improved polishing uniformity.

Therefore, an improved conditioning module and conditioning disks are provided to allow improved pressure distribution across the face of each conditioning disk during a polishing pad conditioning process. Such a pressure distribution allows extended conditioning disk life as well as increased uniformity and rate of polishing pad conditioning.

While the foregoing is directed to embodiments of the present invention, other and further embodiments of the invention may be devised without departing from the basic scope thereof, and the scope thereof is determined by the claims that follow.

The invention claimed is:

1. A module for conditioning a polishing pad in a chemical mechanical polishing system, comprising:

a vertical support post rotatable on a central axis and having a support arm extending laterally therefrom;

a plurality of conditioning heads attached to the support arm and extending downwardly therefrom;

a single bearing member attaching the plurality of conditioning heads to the support arm; and a conditioning disk extending downwardly from each conditioning head, wherein each conditioning disk comprises a compliant portion and an abrasive portion wherein the compliant portion comprises a spiral shaped disk backing member, and the spiral shaped disk backing member has a plurality of slots disposed therethrough.

2. The module of claim 1, wherein each slot extends inwardly from an outer periphery of the spiral.

3. The module of claim 2, wherein each slot is angularly offset from a radial line of the spiral shaped disk backing member.

4. The module of claim 3, wherein the angle of offset is between about 20 and about 45 degrees.

5. A disk for conditioning a polishing pad in a chemical mechanical polishing system, comprising;

a compliant support member;

an abrasive sheet member adjacent the compliant support member; and a backing member disposed between the compliant support member and the abrasive sheet member, wherein the backing member comprises a spiral shaped disk, the spiral shaped disk of the backing member has a plurality of slots disposed therethrough, and each slot extends inwardly from a periphery of the spiral shaped disk.

6. The disk of claim 5, wherein each slot is angularly offset from a radial line of the spiral shaped disk, and the angle of offset is from between about 20 to about 45 degrees.

7. The disk of claim 6, wherein the compliant support member comprises foam.

8. The disk of claim 6, wherein the compliant support member comprises a flexible, fluid filled membrane.

9. The disk of claim 6, wherein the fluid pressure of the flexible, fluid filled membrane is adjustable.

10. A method of conditioning a polishing pad in a chemical mechanical polishing system, comprising:

applying a plurality of conditioning disks to a polishing pad, wherein the plurality of conditioning disks extend downwardly from a plurality of conditioning heads attached to a support arm and extending downwardly therefrom, a single bearing member attaches the plurality of conditioning heads to the support arm, and each of the plurality of conditioning disks comprises:

a compliant support member;

a spiral shaped backing member attached to the compliant support member; and an abrasive sheet member attached to the spiral shaped backing member; and moving the plurality of conditioning disks, the polishing pad, or both, wherein the spiral shaped backing member has a plurality of slots disposed therethrough and extending inwardly from periphery of the spiral shaped backing member.

11. The method of claim 10, wherein each slot is angularly offset from a radial line of the spiral shaped backing member by an amount ranging from about 20 to about 45 degrees.

12. The method of claim 11, wherein the compliant support member comprises a fluid pressurized bladder.

13. The method of claim 11, wherein the compliant support member comprises foam.

14. The method of claim 11, wherein the abrasive sheet member is a diamond impregnated tape.

* * * * *

UNITED STATES PATENT AND TRADEMARK OFFICE

CERTIFICATE OF CORRECTION

PATENT NO. : 8,550,879 B2
APPLICATION NO. : 12/256845
DATED : October 8, 2013
INVENTOR(S) : Chen et al.

It is certified that error appears in the above-identified patent and that said Letters Patent is hereby corrected as shown below:

IN THE CLAIMS:

Column 7, Claim 9, Line 11, please delete "6" and insert --8-- therefor.

Signed and Sealed this
Fourth Day of February, 2014

Michelle K. Lee

Michelle K. Lee
*Deputy Director of the United States Patent and Trademark Office*